US007540684B1

(12) United States Patent
Lukasik

(10) Patent No.: US 7,540,684 B1
(45) Date of Patent: Jun. 2, 2009

(54) INTERLOCKING RUBBER MAT RESEMBLING A PAVING STONE SURFACE

(75) Inventor: Mark Lukasik, Edmonton (CA)

(73) Assignee: Champagne Edition Inc., Legal (CA)

( * ) Notice: Subject to any disclaimer, the term of this patent is extended or adjusted under 35 U.S.C. 154(b) by 0 days.

(21) Appl. No.: 11/944,373

(22) Filed: Nov. 21, 2007

(51) Int. Cl.
*E01C 5/18* (2006.01)

(52) U.S. Cl. ..... 404/33; 404/32; 404/35; 404/40; 404/41

(58) Field of Classification Search ..... 404/32–35, 404/37, 38, 40, 41, 42; D25/113
See application file for complete search history.

(56) References Cited

U.S. PATENT DOCUMENTS

| | | | | |
|---|---|---|---|---|
| 2,099,149 A | | 11/1937 | Turnquist | |
| 2,680,698 A | | 6/1954 | Schnee | |
| 2,999,431 A | | 9/1961 | Mitchell | |
| 3,846,945 A | * | 11/1974 | Roby | 52/177 |
| 3,857,749 A | | 12/1974 | Yoshida | |
| 4,018,025 A | | 4/1977 | Collette | |
| 4,128,357 A | * | 12/1978 | Barth et al. | 404/41 |
| 4,185,939 A | * | 1/1980 | Barth et al. | 404/38 |
| 4,287,693 A | | 9/1981 | Collette | |
| 5,556,228 A | * | 9/1996 | Smith | 405/16 |

OTHER PUBLICATIONS

Paver Depot Products, Legend Series, on-line catalog, n.d., <http://www.paverdepot.com/abbots.html> [retrieved Jul. 6, 2005], 2 pages.

* cited by examiner

*Primary Examiner*—Gary S Hartmann
(74) *Attorney, Agent, or Firm*—Christensen O'Connor Johnson Kindness PLLC

(57) ABSTRACT

A tile for an interlocking rubber mat includes a tile body having an upper surface, a lower surface, and a rectangular peripheral edge. The upper surface is imprinted with a repeating paving stone pattern of a square adjacent an octagon. Each square has four sides of equal length, and each octagon has every second side equal to the sides of the square. A series of projections extend beyond at least one side of the peripheral edge, the space between the projections being adapted to receive the projections of an adjacent tile. Each projection includes a projecting square and a projecting octagon, wherein the projecting square of each projection is adjacent a peripheral octagon of the at least one side of the peripheral edge and the projecting octagon is adjacent a remote side of the projecting square opposite the peripheral octagon. Each peripheral octagon on the at least one side having an associated projection.

4 Claims, 2 Drawing Sheets

INTERLOCKING RUBBER MAT RESEMBLING A PAVING STONE SURFACE

FIELD

The present application relates to an interlocking rubber mat that are used to create a surface that resembles a paving stone surface.

BACKGROUND

Paving stones are used to create walkways, driveways, and other such surfaces for decorative reasons.

SUMMARY

There is provided a tile for an interlocking rubber mat, including a tile body having an upper surface, a lower surface, and a rectangular peripheral edge having four sides. The upper surface is imprinted with a repeating paving stone pattern of a square adjacent to an octagon. Each square has four sides of equal length, and each octagon has every second side equal to the sides of the square. A series of projections extend beyond at least one of the sides of the peripheral edge, the space between the projections being adapted to receive the projections of an adjacent tile. Each projection includes a projecting square and a projecting octagon, wherein the projecting square of each projection is adjacent a peripheral octagon of the at least one of the sides of the peripheral edge and the projecting octagon is adjacent a remote side of the projecting square opposite the peripheral octagon. Each peripheral octagon on the at least one of the sides having an associated projection.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
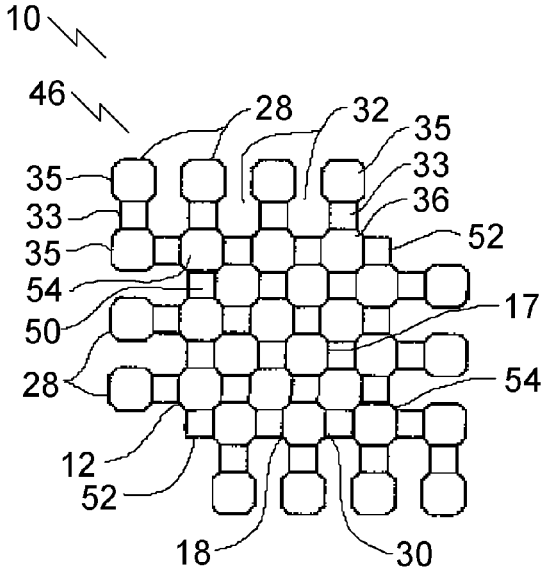
FIG. 1 is a top plan view of an interior tile.

A tile for an interlocking rubber mat generally identified by reference numeral 10, will now be described with reference to FIGS. 1 through 8.

Figure 5:
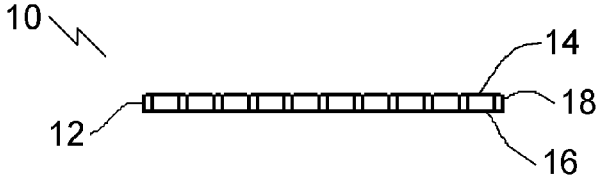
FIG. 5 is a side plan view of the interior tile of FIG. 1.
Figure 7:
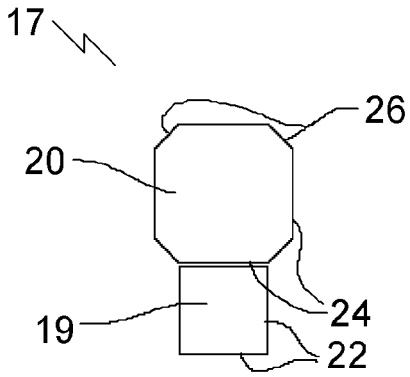
FIG. 7 is a top plan view of an example of a paving stone pattern.
Figure 8:
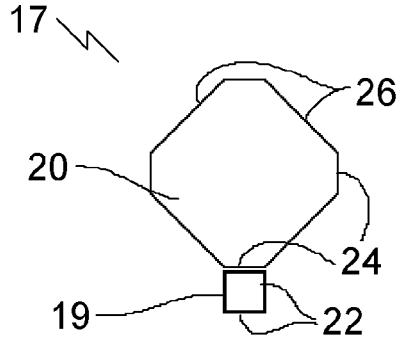
FIG. 8 is a top plan view of a second example of a paving stone pattern.

Structure and Relationship of Parts:

Referring to FIG. 5, tile 10 made of rubber has a tile body 12 having an upper surface 14, a lower surface 16, and, referring to FIG. 1, a rectangular peripheral edge 18 made up of peripheral octagons 36 and squares 50. As depicted, rectangular peripheral edge 18 is a square, having four sides 30. Upper surface 14 is imprinted with a repeating paving stone pattern 17, which includes recessed lines to imitate the look of actual paving stones. Referring to FIG. 7 pattern 17 is made up of a square 19 adjacent an octagon 20. Each square 19 has four sides 22 of equal length, and each octagon 20 has every second side 24 equal to sides 22 of square 19 and adapted to be placed adjacent to a square 19. Sides 24 of octagon 20 need not be larger than the remaining sides 26, they may also be smaller, as can be seen in FIG. 8. As projections 28 discussed below are attached by square 19, the size of square 19, and thus sides 24 of octagon 20 are limited by the structural requirements.

Referring to FIG. 1, tiles 10 are interlocked by providing a series of projections 28 extending beyond sides 30 of peripheral edge 18, where the space 32 between projections 28 is adapted to receive projections 28 of an adjacent tile, as will be discussed below. Each projection 28 includes a projecting square 33 and a projecting octagon 35. Projecting square 33 of each projection 28 is adjacent a peripheral octagon 36 of side 30 and projecting octagon 35 is adjacent a remote side of projecting square 33 opposite peripheral octagon 36. Each peripheral octagon 36 on side 30 has an associated projection 28.

Figure 2:
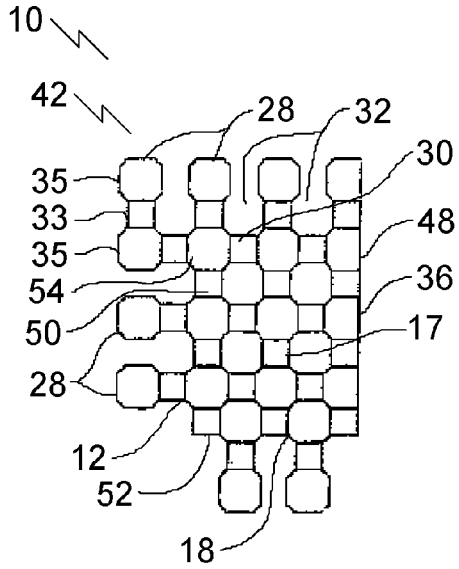
FIG. 2 is a top plan view of a side tile.
Figure 3:
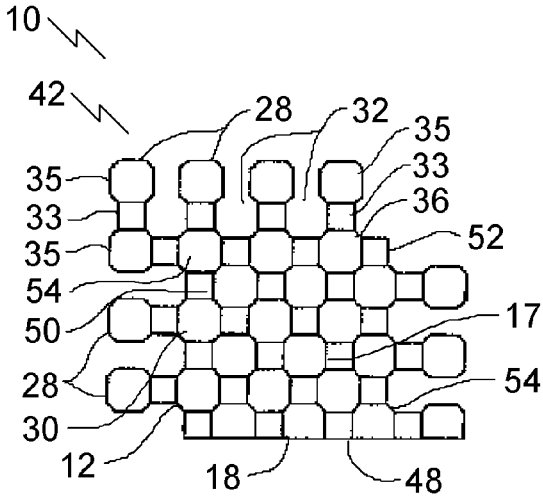
FIG. 3 is a top plan view of a different side tile.
Figure 4:
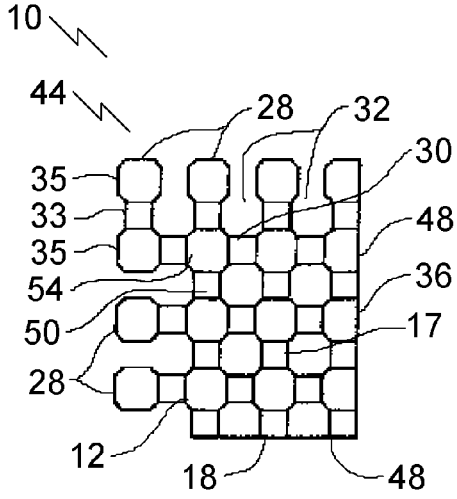
FIG. 4 is a top plan view of a corner tile.
Figure 6:
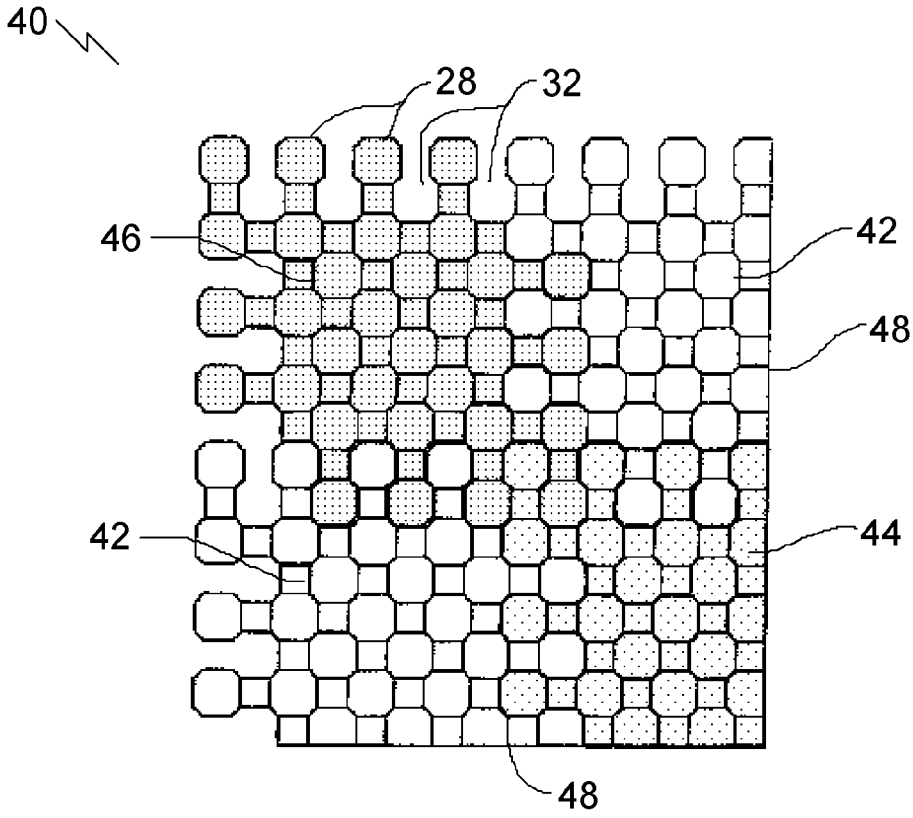
FIG. 6 is a top plan view of a rubber mat.

Referring to FIG. 6, a mat 40 may be formed by interlocking different types of tiles 10, such as edge tiles 42, corner tiles 44, and intermediate tiles 46. Intermediate tile 46 and corner tile 44 have been shaded to help distinguish the tiles when interlocked. FIGS. 1 through 4 show each tile 42, 44 and 46 separately. Referring to FIGS. 2 through 4, edge tiles 42 and corner tiles 46 have flat sides 48 along peripheral edge 18 to provide a finished look. Because of this, peripheral octagons 36 on flat sides 48 are only partial octagons, such that they are flush with the peripheral squares 50. Depending on the size requirements, peripheral squares 50 may also be only partial squares (not shown) to reduce the length or width of tiles 10, as the case may be. Other types of tiles 10 may also be used, where flat sides 48 are shaped or curves, such as when a curved walkway or corner is desired. Referring to FIG. 1, the shape of intermediate tiles 46 is such that they are all the same size and shape, for ease of production and installation. For intermediate tiles 46, projections 28 extend beyond each side 30 of peripheral edge 18. Each side 30 of peripheral edge 18 is designed such that there are an equal number of peripheral octagons 36 and peripheral squares 50 (although one side 30 may have a different number than another side, to obtain a rectangular instead of the square shape that is depicted). As a result, two opposed corners are squares 52 that do not have projections 28, and two are octagons 54, that have projections 28. Each corner octagon 54 has two projections 28, where one of projections 28 has an additional projecting square 33 and projecting octagon 35 that form a right angle, with the first projecting octagon 35 at the apex of the right angle, and such that the further projecting square 33 and octagon 35 are parallel to other projection 28 of corner octagon 54.

Operation:

The use of tiles 10 to form a rubber mat 40 as described above with reference to FIGS. 1 through 8 will now be discussed. Referring to FIG. 6, edge tiles 42 and corner tiles 44 are used to make up the outside of mat 40, with intermediate tiles 46 on the inside. The length of sides 30 with projections 28 are all similar, such that mat 40 is complete. Referring to FIG. 1, each tile 10 is interlocked together by fitting projections 28 into spaces 32 between projections 28 in an adjacent tile. Because pattern 17 is repeating, fitting projections 28 into spaces 32 merely allows pattern 17 to continue between tiles 10. Referring to FIG. 6, edges 44 and 48 are chosen to fit within the space required.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope defined in the Claims.

What is claimed is:

1. A tile for an interlocking rubber mat, comprising:

a tile body having an upper surface, a lower surface, and a rectangular peripheral edge having four sides;

the upper surface being imprinted with a repeating paving stone pattern of a square adjacent to an octagon, each square having four sides of equal length, each octagon having every second side equal to the sides of the square; and a series of projections extending beyond at least one of the sides of the peripheral edge, the space between the projections being adapted to receive the projections of an adjacent tile, each projection including a projecting square and a projecting octagon, wherein the projecting square of each projection is adjacent a peripheral octagon of the at least one of the sides of the peripheral edge and the projecting octagon is adjacent a remote side of the projecting square opposite the peripheral octagon, each peripheral octagon on the at least one of the sides having an associated projection, the series of projections extending beyond each of the sides of the peripheral edge, wherein exactly two opposed corners of the peripheral edge are octagons, each of these corner octagons having two projections, one of the projections having an additional square and octagon that form a right angle, the right angle having the first projecting octagon at the apex of the right angle, the further square and octagon being parallel to the other projection of the corner octagon.

2. The tile of claim 1, wherein at least one of the sides of the peripheral edge is flat, with the octagons along the peripheral edge truncated to form partial octagons.

3. The tile of claim 1, wherein at least one of the sides of the peripheral edge is flat, with the octagons and squares along the peripheral edge truncated to form partial octagons and squares.

4. A rubber mat formed by interlocking more than one of the tiles of claim 1.

* * * * *